US006418284B1

(12) United States Patent
Mercer

(10) Patent No.: US 6,418,284 B1
(45) Date of Patent: Jul. 9, 2002

(54) SERVICE UNIT FOR AN IMAGE FORMING APPARATUS

(75) Inventor: Christopher Paul Mercer, Dalkeith, WA (US)

(73) Assignee: GCC Management Limited, Kowloon (HK)

( * ) Notice: Subject to any disclaimer, the term of this patent is extended or adjusted under 35 U.S.C. 154(b) by 0 days.

(21) Appl. No.: 09/609,398

(22) Filed: Jul. 3, 2000

(30) Foreign Application Priority Data

Jul. 12, 1999 (GB) ..... 9916304

(51) Int. Cl.[7] ..... G03G 15/08
(52) U.S. Cl. ..... 399/120
(58) Field of Search ..... 399/120, 360, 399/262, 359; 222/DIG. 1; 220/530

(56) References Cited

U.S. PATENT DOCUMENTS 3,931,907 A * 1/1976 Henle ..... 220/530
5,084,734 A 1/1992 Yoshino et al.
5,229,826 A * 7/1993 Sonnenberg ..... 399/360
5,737,668 A * 4/1998 Johroku ..... 399/120
5,907,752 A * 5/1999 Kondoh ..... 399/120

FOREIGN PATENT DOCUMENTS

| | | | |
|---|---|---|---|
| EP | 0470675 A2 | | 2/1988 |
| EP | 59184373 | | 2/1988 |
| JP | 63-298370 | * | 12/1988 |
| JP | 01-090470 | * | 4/1989 |
| JP | 03-153271 | * | 7/1991 |
| JP | 07-281521 | * | 10/1995 |
| JP | 09-211949 | * | 8/1997 |

* cited by examiner

*Primary Examiner*—Robert Beatty
(74) *Attorney, Agent, or Firm*—Liniak, Berenato, Longacre & White

(57) ABSTRACT

A service unit for an electrographic apparatus has a reservoir for storage of fresh toner or developer and a reservoir for storage of waste or depleted toner or developer. The fresh toner reservoir is separable from the waste toner reservoir and detachable from the service unit. The fresh toner reservoir has a wall which, in use, is in contact with a wall of the waste toner reservoir. Both contacting walls are flexible whereby the combined volume of the two reservoirs is less than the sum of the volumes which may be used to store the fresh and waste toner at different stages in the duty cycle of the service unit.

11 Claims, 8 Drawing Sheets

SERVICE UNIT FOR AN IMAGE FORMING APPARATUS

FIELD OF THE INVENTION

The present invention relates to a xerographic apparatus for forming images on paper, such as a copying machine; fax machine; laser printer; LCD or LED printer; or a multi-function device enabling a combination of these functions.

BACKGROUND OF THE INVENTION

The concept of xerography was pioneered by Chester Carlsson in the pre- and post-war years and is well documented in patent and other literature. This work resulted in the first commercial photocopiers in the late 1950's and further developments in the 1960's and 1970's. Throughout this time efforts were made to make the machines cheaper and more compact; and less reliant on service visits from qualified technicians.

A watershed event in ease of service was a development by Canon KK detailed in U.S. Pat. No. 4,538,896 which discloses a process unit which is removable from the main image forming unit and is intended to be discarded. This allows the user to perform a preventive maintenance task without specialised assistance from a service technician.

Since then, Customer Replaceable Units (CRU's) have become commonplace especially in smaller machines dedicated to office and home environments. The CRU may contain one or several assemblies and components which require replacement on a preventative maintenance basis. Typically this may include at least a toner tank for the supply of fresh toner or developer and a waste tank for accomodation of depleted toner or developer. These two vessels usually constitute a significant volume of the CRU.

An example of a CRU predominantly containing these two tanks can be found in U.S. Pat. No. 5,126,799 reissued as RE 35528. In this invention Ricoh Company define a "Cleaner Toner Magazine" (CTM) comprising a toner supply tank and toner recovery tank, joined together as a detachable magazine for user replacement.

As the popularity and number of CRU models has increased, a significant industry has evolved dedicated to the refilling and refurbishing of CRU's. So whilst the Original Equipment Manufacturer may seek to group elements requiring similar replacement intervals into single CRU's, the Refiller may seek to further subdivide the preventative maintenance elements and replace those elements within the CRU that wear the fastest and salvage those elements which may be reused for a further cycle.

It is an object of the present invention to provide a service unit for an image forming apparatus which maximises utilisation of parts which have long life.

In a preferred embodiment the present invention utilises one or more flexible diaphragms to optimise the volume use within a CRU, by allowing fresh toner to occupy a greater proportion of the internal volume at the beginning of life and a lesser proportion of the available volume as the fresh toner is depleted. Conversely the volume available to the depleted or waste toner can be increased during CRU life at the expense of volume dedicated to fresh toner.

Thus the compactness of the CRU can be improved or alternatively the life of the CRU may be extended within the same design and space envelope.

A further embodiment of the invention allows recharging of the CRU itself by supplying the flexible toner reservoir in the form of a disposable or reusable cannister. New cannisters, filled with an appropriate supply of toner can replace spent ones in the CRU.

This allows Remanufacturers to recycle spent CRU's and maximise the utilisation of those parts which are not subject to wear or depletion. As the toner is supplied in a cheap cannister, the need for toner bottles is eliminated.

The invention will now be described by way of example and with reference to the accompanying drawings in which:

DETAILED DESCRIPTION OF CERTAIN PREFERRED EMBODIMENTS

Figure 1:
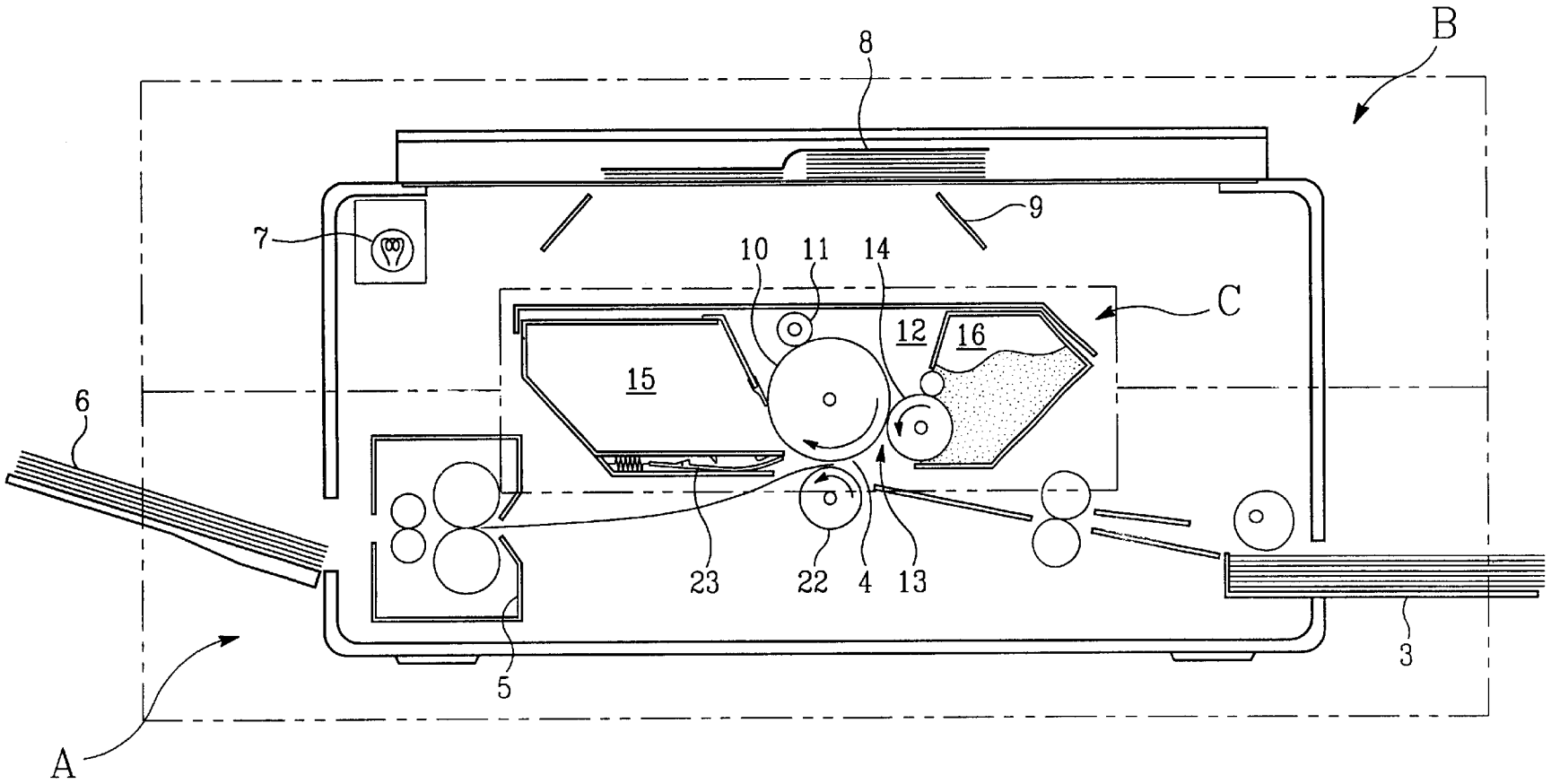
Fig. 1 Prior Art
FIG. 1 (prior art) is a schematic of an image forming apparatus (electrophotographic copier) indicating how the major functional areas can be divided.

With reference to FIG. 1, an image forming apparatus such as an electrophotographic copying machine can be divided into four Sections. The so-called base engine (A) comprises the paper handling mechanisms which feed the paper from a storage cassette (3) through an image receiving section (4) to a fixing unit (5) which employs temperature and pressure to fix the image onto the receiving medium. There is then an output tray (6) to which the medium is fed. The second Section is the image forming section (B) which comprises a light source (7) illuminating an image to be copied (8), this illumination being reflected off the subject image through an optical system (9) and finally focused on to a photosensitive drum (10). The photosensitive drum is part of the third main Section which may be termed the xerographic section (C). The drum (10) is charged by a charging device (11) prior to exposure to said light image. Having rotated past the image receiving section (12) where the charged surface is selectively discharged to form an electrical version of the image (latent image) the surface of the photosensitive drum passes a development zone (13) where a layer of toner and/or developer (14) is exposed to the latent image and electrostatic and/or magnetic forces cause the toner to transfer to the surface of the drum in the pattern of the latent image. The drum rotates further to a transfer section (4) where electrical and/or electrostatic forces cause the toner to transfer to the receiving medium. Any toner or developer remaining on the drum is cleaned off at a cleaning station (15). The fourth Section (D—not shown) of such a copying device is the control electronics which comprise power supplies and controllers for supervising the various operations of the machine.

In digital applications such as laser beam printers or digital copiers, Section B differs in that a laser beam is used to generate the light image. The beam is modulated or pulsed to form "light dots" which are scanned in a raster fashion across the photosensitive drum. Section D differs in that substantial hardware and software are dedicated to image preparation and rasterisation of the page image. Sections A and C can be very similar to the electrophotographic copier described above.

In the art there are two technology variants according to the structure of the ink powder. Dual component development uses a "carrier" and a "toner" which comprise a "developer". The carrier, which can be thought of as iron beads, is responsible to act under electrostatic and/or magnetic forces and transport the toner to the appropriate locations. The toner is then the pigment which is transported and ultimately marks the paper. The second variant is monocomponent toner which combines both functions in a single compounded powder. Where practicable and unless otherwise stated this text shall employ the generic term "toner" to describe the various powders.

"Fresh Toner" is used to describe a new supply of powder to the system. This may be a single powder, a compound or a mixture of powders or compounds. "Waste Toner" is that powder which is not transferred to paper. Usually this is wrong-sign or wrong-size toner which passes the transfer station without transferring to the print medium and is subsequently cleaned from the photoconductor and stored in a waste vessel and/or recirculated for repeat use. However toner may be depleted in other ways and segregated as waste before reaching the development station. An example of this would be a dual component system where the properties of the carrier may become depleted during the mixing and augering operations even prior to development and require purging.

It is now necessary to consider which areas of the xerographic system can be grouped together to comprise a CRU. This is dictated by geometry, layout and the expected service life of the various components.

FIG. 2 shows three typical CRU constructions.

Figure 2A:
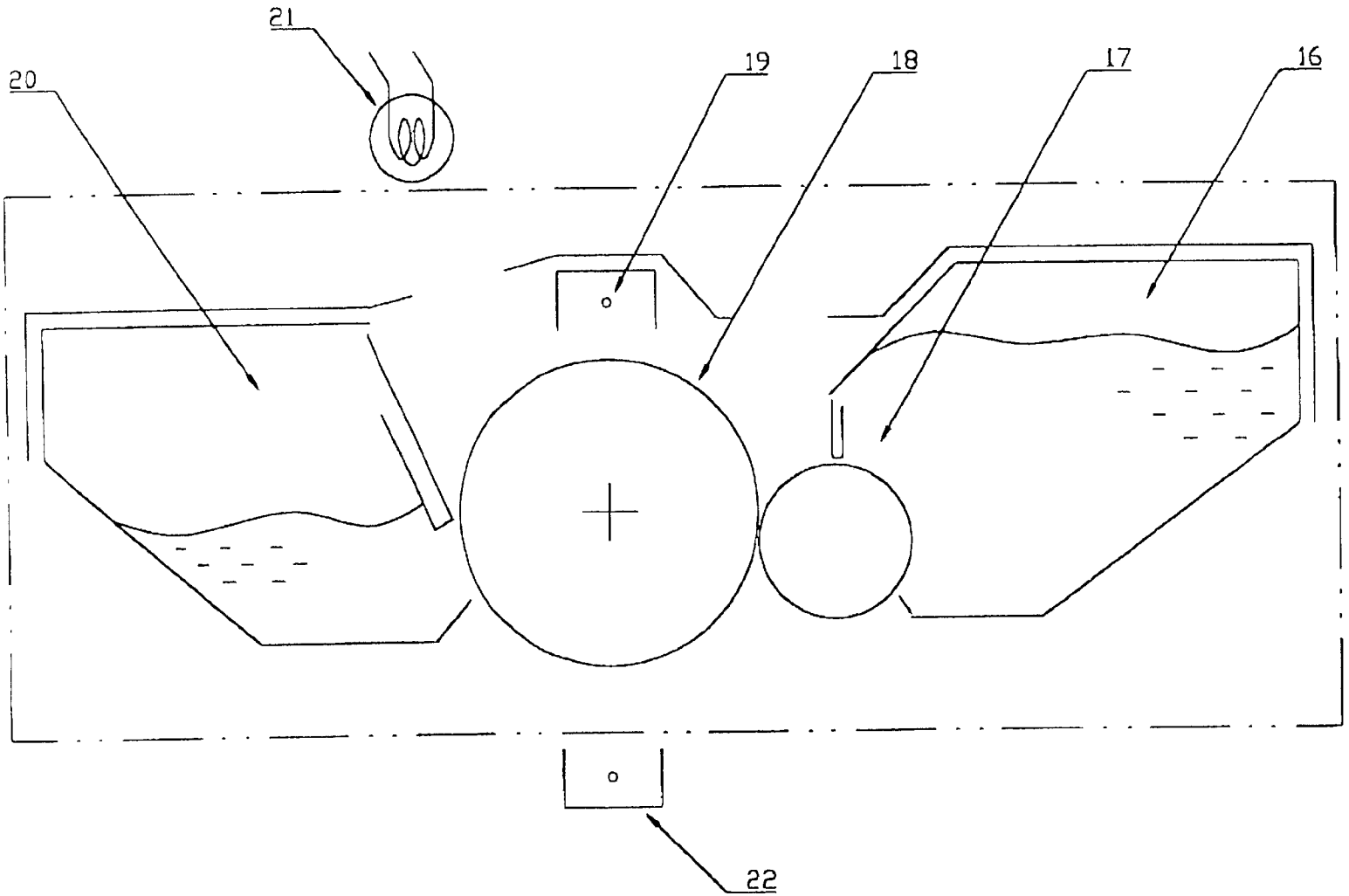
Fig. 2a (Prior Art)
FIG. 2 (prior art) shows three configurations (a,b,c) of Service Unit elements which might be provided for preventative maintenance or refresh of consumables of such an image forming apparatus.

FIG. 2*a* shows a CRU comprising a monocomponent toner reservoir (16); a developer section(17); a Photoconductive Drum (18); a Charging Device (19); and a cleaning unit with waste reservoir (20). In configurations such as these the manufacturer has deemed it unnecessary to include the photoconductor reconditioning lamp (21) and transfer charger(22) into the CRU.

Figure 2B:
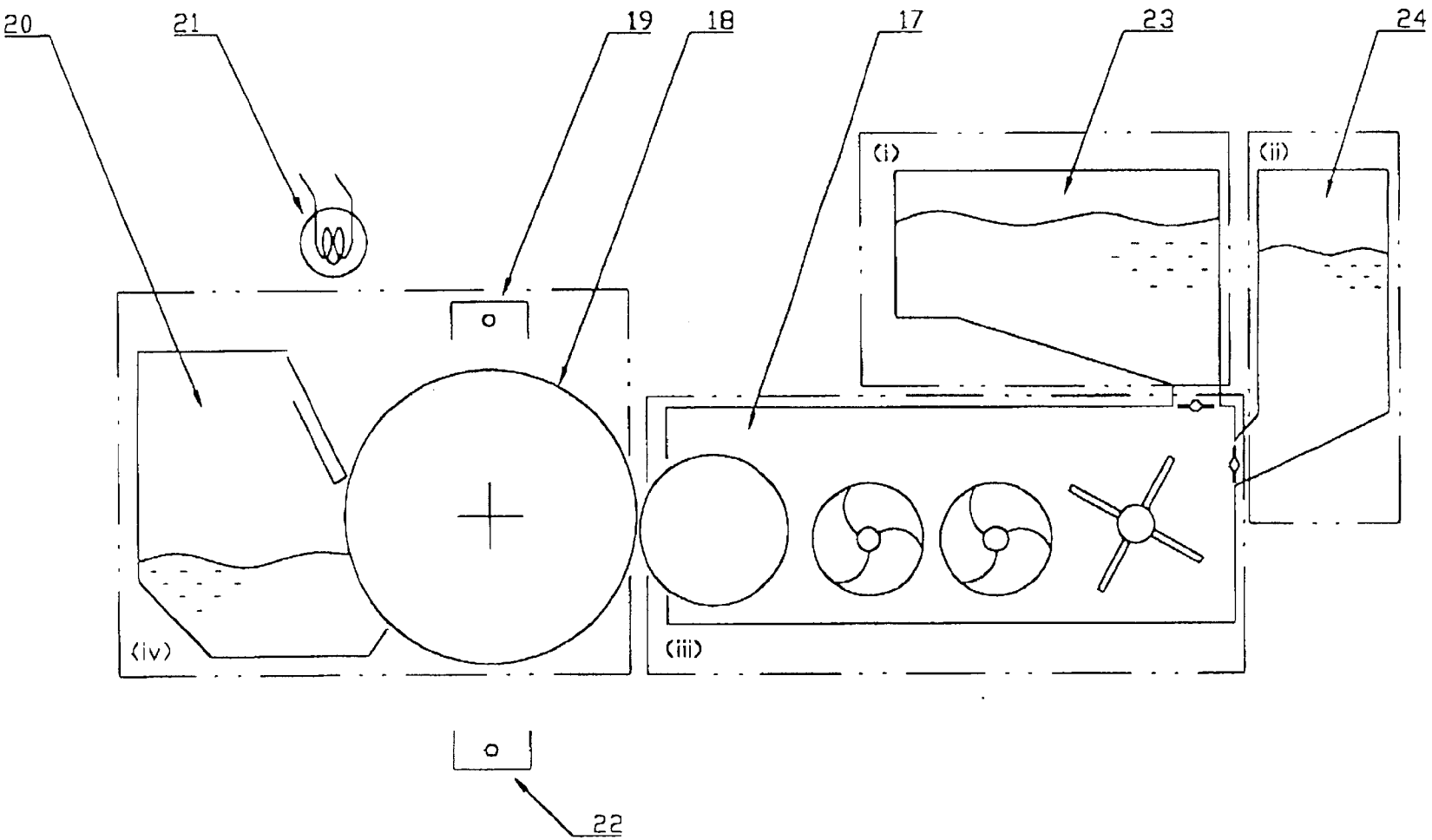
Fig. 2b (Prior Art)

FIG. 2*b* shows a simplified dual component development system with system elements numbered as per FIG. 2*a*. However the developer section is much more complex as it involves mixing and augering of the toner and carrier. Separate bottles are shown supplying toner(23) and carrier (24). In this case several replaceable units can be defined:

(i) Toner Supply (ii) Carrier Supply (iii) Developer Unit (iv) Photoconductor and Waste Unit The above are listed in ascending order of service life. In such systems the Toner Supply might have to be exchanged up to say, six times for each replacement Photoconductor and Waste Unit.

Figure 2C:
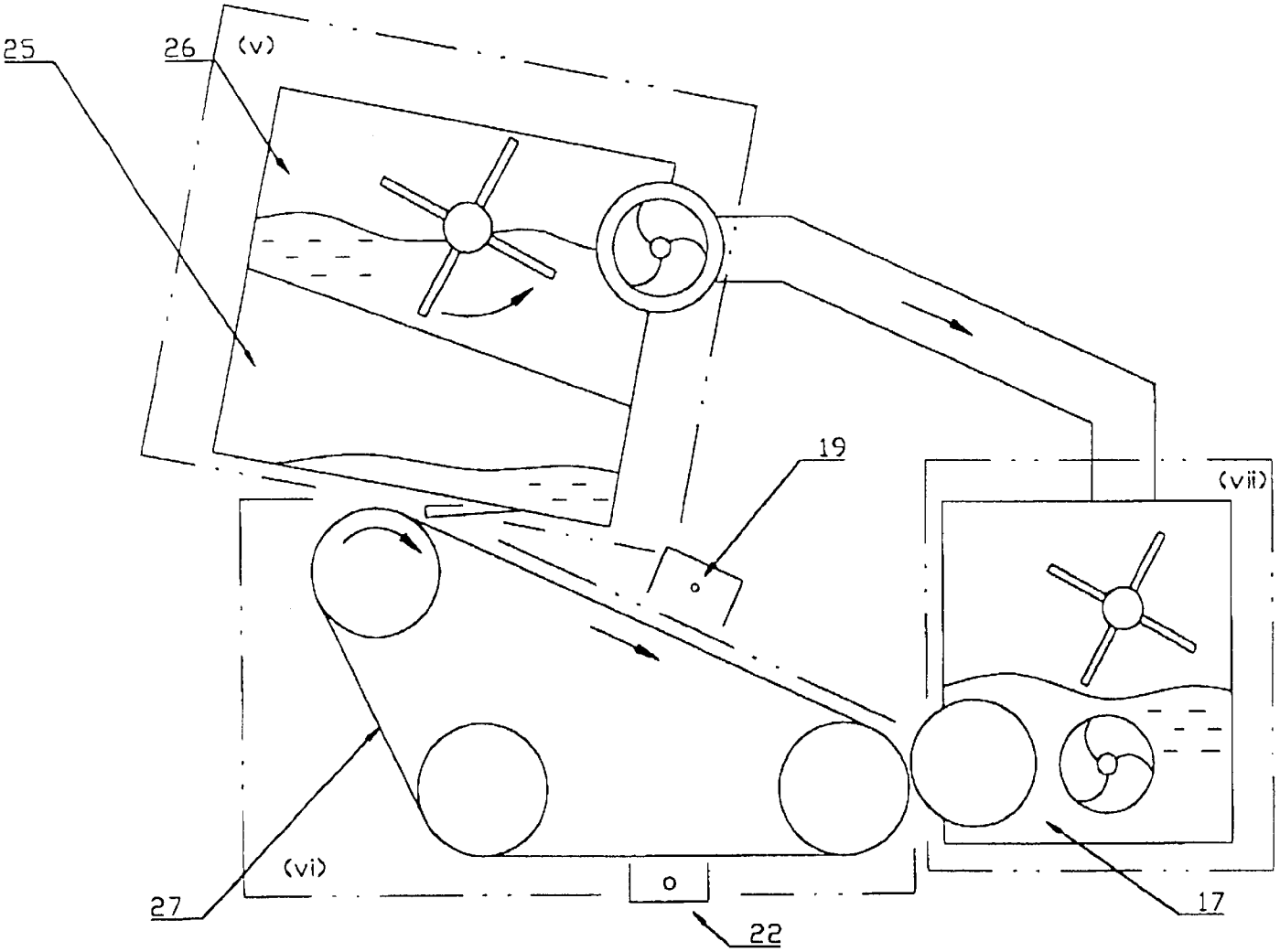
Fig. 2c (Prior Art)

FIG. 2*c* shows a system comprising one unit containing Waste (25) and Fresh Toner (26) Reservoirs adjacent to each other; a seperate developer unit (17); and a seperate photoconductor belt (27) unit. In ascending order of service life these can be listed as:

(v) Fresh and Waste Toner magazine;

(vi) Photoconductor Belt;

(vii) Developer, Augering and Mixing Unit.

The preferred embodiment detailed below will use the system shown in FIG. 2*c* as representative, although the principles can be extended to the other configurations (and similar configurations not represented in FIG. 2) as well.

Figure 3A:
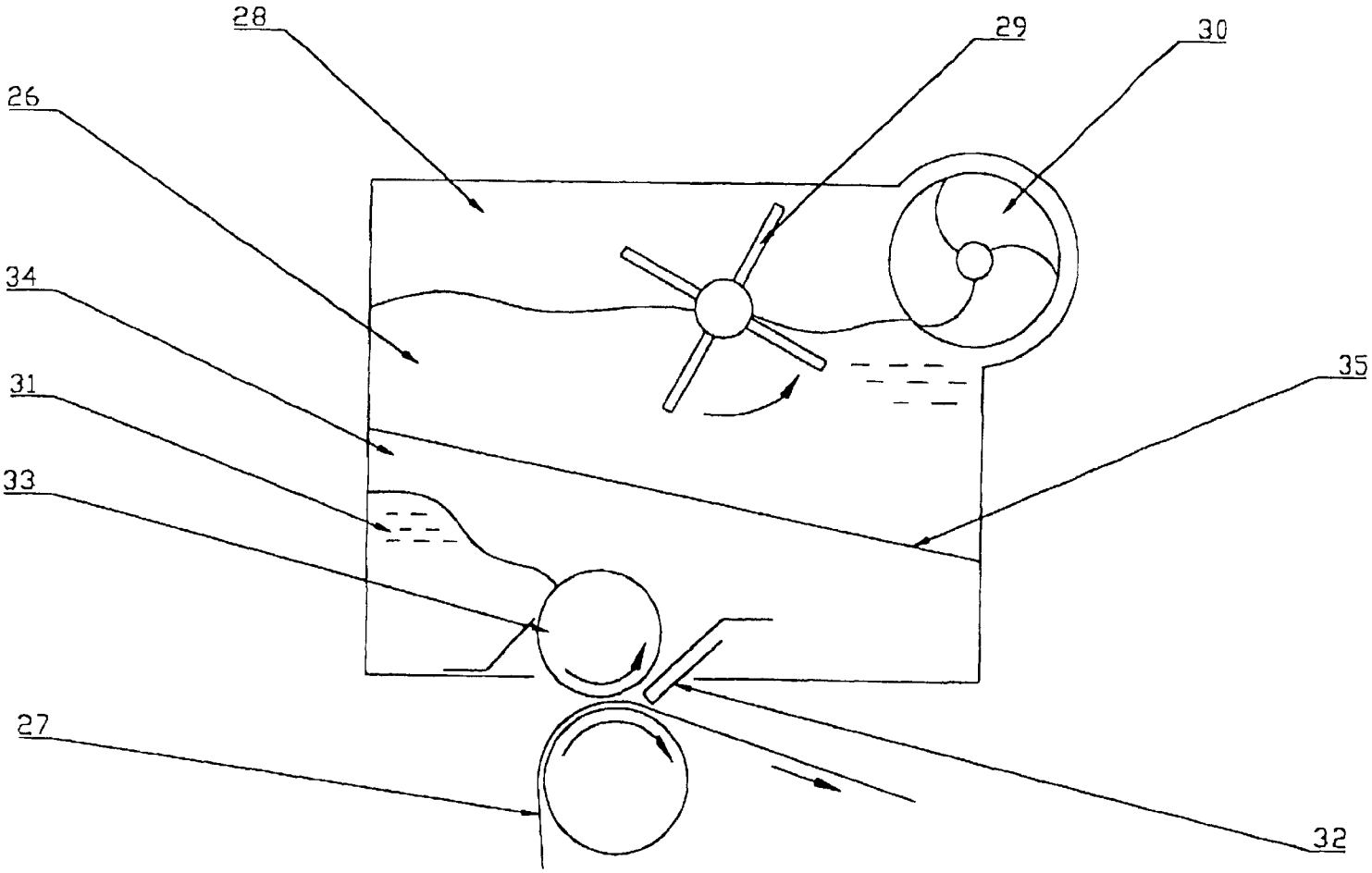
Fig. 3a (Prior Art)
FIG. 3*a* (prior art) shows a Cleaner Toner Magazine (CTM) as might be used in configuration 2*c*(v).

FIG. 3*a* shows the prior art represented by the fresh and waste toner magazine (item (v)) in FIG. 2*c* in more detail. Fresh Toner (26) is provided in a reservoir (28). An agitator system (29) rotates to maintain a constant supply of Fresh Toner to the Auger (30) which carries the toner to an outlet (not shown) from where it is transported to a remote development system ((vii) in FIG. 2*c*). After development, depleted toner (31) is cleaned off the exposed photoconductive belt (27) by a polyurethane blade (32). A rotating magnet (33) carries the depleted toner into the waste reservoir (34). The waste reservoir shares a compartment wall (35) with the fresh toner reservoir.

Figures 3B, 3C:
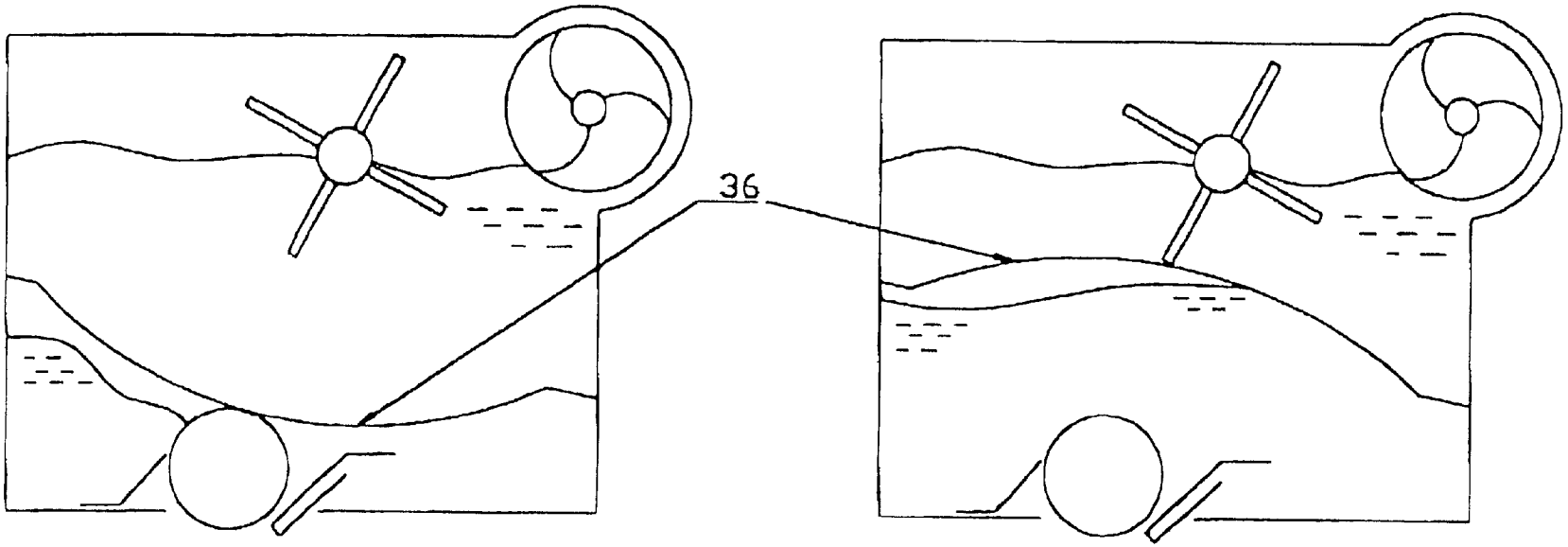
FIGS. 3*b* and 3*c* show a Cleaner Toner Magazine (CTM) employing a flexible diaphragm between the Fresh and Waste Toner reservoirs at different stages in the duty cycle of the CTM.

FIG. 3*b* illustrates a simplification of the Preferred Embodiment of the invention at the beginning of service life when there is an abundance of Fresh Toner and little or no Waste Toner in the system. In this embodiment the compartment wall (36) comprises a flexible diaphragm allowing the Fresh Toner reservoir at the beginning of service life to extend into the area currently not being used by waste toner.

FIG. 3*c* shows the same embodiment towards the end of the service cycle when the Fresh Toner has been substantially depleted and the amount of Waste Toner is maximised. It can be seen that the diaphragm has cupped in the opposite direction to allow a greater proportion of the whole volume to be occupied by the Waste Toner, at the expense of the Fresh Toner reservoir which is substantially empty.

Hence the volume available to Fresh Toner (at the beginning of the service cycle) added to the volume available to Waste Toner (at the end of the service cycle) is greater than the total volume of the two reservoirs (at any one time). This is the essence of the invention.

Figure 4:
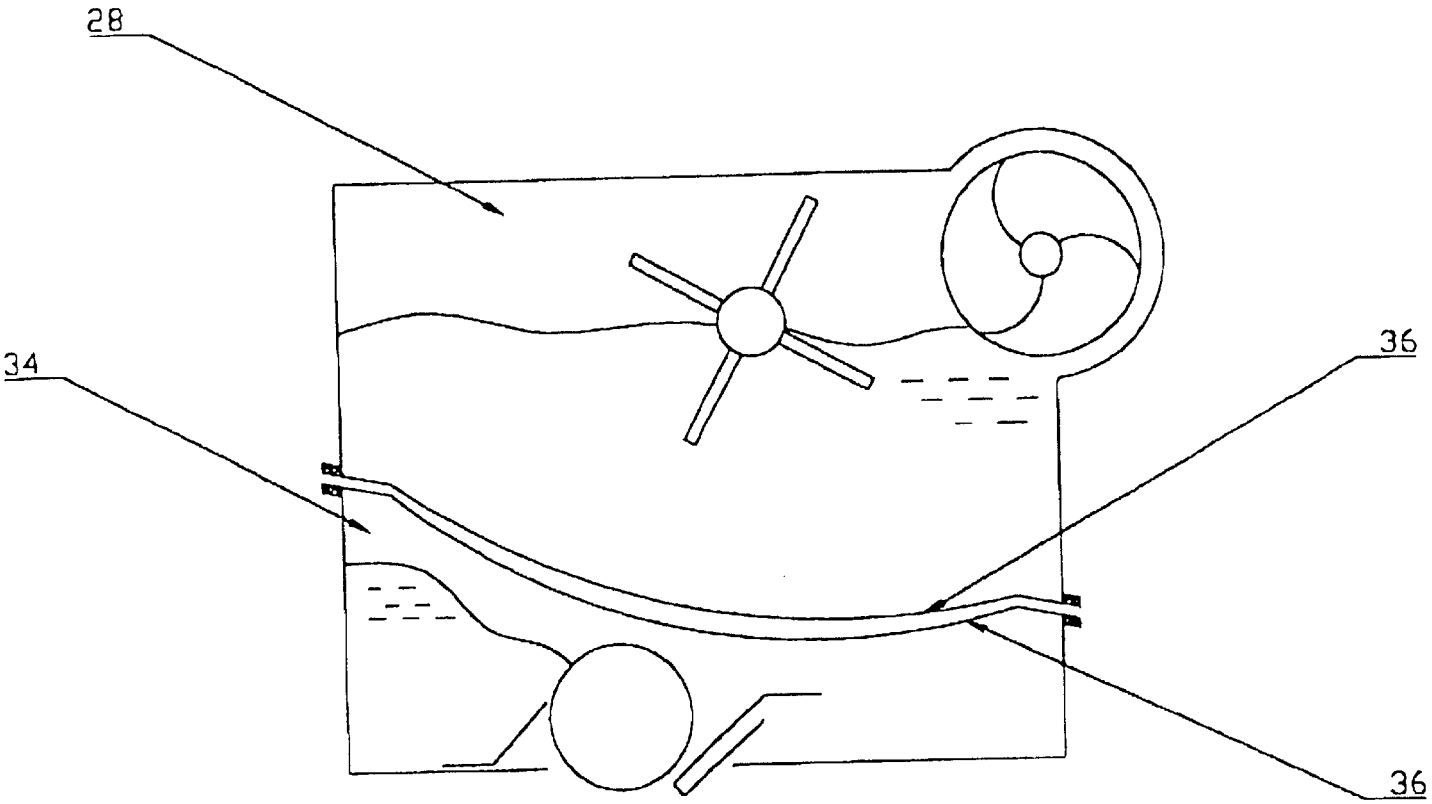
FIG. 4 shows a further embodiment of the current invention employing two flexible walls.

FIG. 4 shows the same system with two diaphragms between the Fresh and Waste Toner areas. This configuration allows for easier construction and recycling of the unit as the two reservoirs can be manufactured and remanufactured separately.

Figure 5:
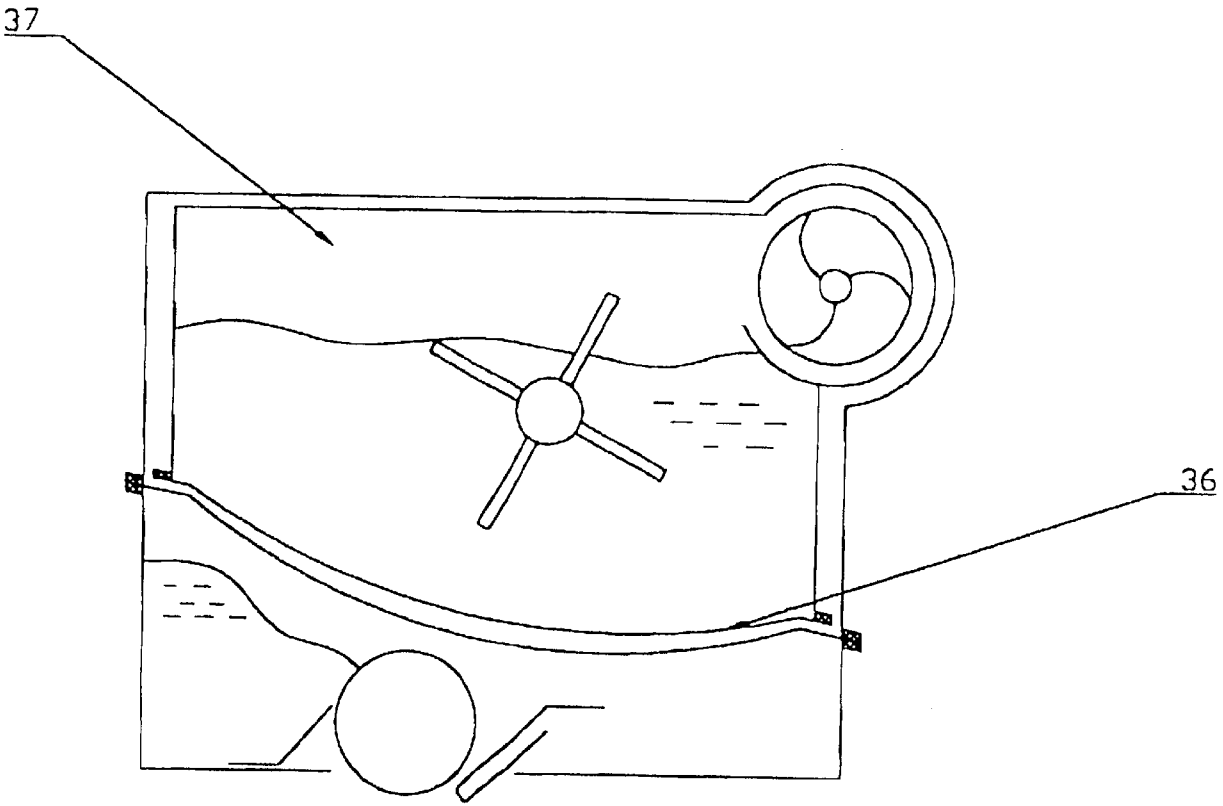
FIG. 5 shows a variation of FIG. 4 whereby the Fresh Toner reservoir is detachably mounted within the magazine body.

FIG. 5 shows the same system with a replacable Fresh Toner Cannister (37) within the magazine. The cannister has a diaphragm (36) in place of one wall which will bulge out when the cannister is full and cup inwards when the cannister is empty, allowing the diaphragm on the Waste side to bulge into the cupped space and increase the volume available to the waste toner.

The cannister body can be made of a relatively cheap material such as vacuum formed plastic or recycled paper fibre, moulded into shape. Hence the remanufacturer can recharge the magazine by cleaning out the waste toner reservoir and replacing the empty toner cannister with a freshly charged one. This reduces waste to a minimum and allows quick and reliable remanufacture.

In dual component systems the waste toner might come from the photoconductor cleaning station and also the developer augering and mixing station where the properties of the carrier may become depleted during the mixing and augering operations.

The principles of the present invention may apply as equally to customer replaceable units as to other maintenance units designed for replacement by qualified service technicians. The term Service Unit as employed herein is intended to cover any unit containing parts which require replacement at pre-determined intervals and/or fresh supplies of consumable material.

What is claimed is:

1. A service unit for an electrographic apparatus having a reservoir for storage of fresh toner or developer and a reservoir for storage of waste toner or developer, the fresh toner reservoir being separable from the waste toner reservoir and detachable from the service unit, wherein the fresh toner reservoir has a wall which, in use, is in direct contact with a wall of the waste toner reservoir and wherein both of the contacting walls are flexible whereby the combined volume of the two reservoirs is less than the sum of the volumes which may be used to store the fresh and waste toner at different stages in the duty cycle of the service unit.

2. A service unit as claimed in claim 1 wherein the contacting walls comprise diaphragms.

3. A service unit as claimed in claim 1 wherein the fresh toner reservoir and the waste toner reservoir are joined together to form a toner magazine.

4. A service unit as claimed in claim 3 wherein the magazine is detachable from the service unit.

5. A service unit as claimed in claim 1 wherein the fresh toner reservoir and the waste toner reservoir are joined together to form a process cartridge which includes a photosensitive drum.

6. A service unit as claimed in claim 1 wherein the service unit includes a main body and wherein the fresh toner reservoir is mounted in use in the main body of the service unit.

7. A service unit as claimed in claim 1 wherein the fresh toner reservoir is in the form of a disposable canister.

8. A service unit as claimed in claim 1 wherein said flexible contacting wall of said fresh toner reservoir spans substantially the entire length and width of said reservoir.

9. A service unit as claimed in claim 8 wherein said flexible contacting wall of said waste toner reservoir spans substantially the entire length and width of said reservoir.

10. A service unit as claimed in claim 1 wherein said fresh toner reservoir can be separated from said waste toner reservoir and detached from said service unit without detaching or opening said waste toner reservoir.

11. A service unit for an electrographic apparatus comprising:

an image forming section including a photoconductor unit and a developer unit, and a reservoir for storage of fresh toner and developer and a reservoir for storage of waste toner or developer, the fresh toner reservoir being separable from the waste toner reservoir and detachable from the service unit, wherein the fresh toner reservoir has a wall in which, in use, is in contact with a wall of the waste toner reservoir and wherein both of the contacting walls are flexible whereby the combined volume of the two reservoirs is less than the sum of the volumes which may be used to store the fresh waste toner at different stages in the duty cycle of the service unit.

* * * * *